US007328731B2

(12) United States Patent
Russell

(10) Patent No.: US 7,328,731 B2
(45) **Date of Patent: *Feb. 12, 2008**

(54) VACUUM RELEASE DEVICE AND METHOD

(75) Inventor: Andrew Russell, Chandler, AZ (US)

(73) Assignee: RAM Research, LLC, Tucson, AZ (US)

( * ) Notice: Subject to any disclaimer, the term of this patent is extended or adjusted under 35 U.S.C. 154(b) by 265 days.

This patent is subject to a terminal disclaimer.

(21) Appl. No.: 11/012,704

(22) Filed: Dec. 15, 2004

(65) Prior Publication Data

US 2006/0150789 A1 Jul. 13, 2006

(51) Int. Cl.
*B65B 1/04* (2006.01)

(52) U.S. Cl. ..... 141/329; 141/65; 215/311; 220/231

(58) Field of Classification Search ..... 141/65, 141/329, 330, 98, 119; 215/228, 311; 220/212, 220/212.5, 231; 222/5, 80, 81, 83, 83.5, 222/85–87, 89, 90

See application file for complete search history.

(56) References Cited

U.S. PATENT DOCUMENTS 4,081,006 A * 3/1978 Crowell et al. ..... 141/330
4,191,310 A * 3/1980 Bernhardt et al. ..... 222/5
4,218,967 A 8/1980 Batchelor
5,406,992 A 4/1995 Miramon
5,601,124 A * 2/1997 Weinheimer et al. ..... 141/19
5,732,752 A * 3/1998 Glessner et al. ..... 141/329
5,955,127 A 9/1999 Glaser
6,035,508 A 3/2000 Smith
7,140,402 B2 * 11/2006 Russell ..... 141/65

* cited by examiner

*Primary Examiner*—Steven O. Douglas
(74) *Attorney, Agent, or Firm*—Noblitt & Gilmore, LLC

(57) ABSTRACT

An exemplary method for releasing a vacuum seal is disclosed as comprising inter alia puncturing a portion of a lid closure with a penetrator device and optionally sealing the puncture with a laminar valve or thin film held in place with PST or other suitable adhesive. Disclosed features and specifications may be variously controlled, adapted or otherwise optionally modified to improve release of a vacuum seal for any application or operating environment. Exemplary embodiments of the present invention generally provide for quick, easy and safe opening of vacuum packaged containers for food products.

19 Claims, 5 Drawing Sheets

VACUUM RELEASE DEVICE AND METHOD

FIELD OF INVENTION

The present invention generally concerns devices, systems and methods for releasing a vacuum seal; and more particularly, in various representative and exemplary embodiments, to devices adapted to facilitate the vacuum release of lids, caps or other closures from jars, bottles or other containers.

BACKGROUND

It is well known that perishable foods stored at reduced pressure maintain their freshness longer. Food articles, such as tea, fruit, nuts, preserves, etc. may be vacuum sealed in order to maintain freshness over extended periods of time. In general, vacuum packed foods will begin to loose their freshness the moment the vacuum seal provided during original packaging is lost.

Vacuum sealed containers are generally well known. Typical vacuum sealed vessels may include containers for food products, such as: jelly, pickles, condiments, beverages, baby food, and the like. In some vacuum sealed containers, the lid may be at least partially held against the containment volume by the reduced pressure of the vacuum seal itself. Releasing the vacuum seal will generally allow for removal of the lid closure.

In other vacuum sealed containers, the lid may also be adapted for threaded engagement with the container, such that removal of the lid may involve both releasing the vacuum seal and unscrewing the lid. Often, the lids of vacuum sealed containers may be formed with a slight concave depression near the center of the lid, indicating that the vacuum seal has not been compromised. After the vacuum seal has been released, the depression may be convex or domed and/or flexible to manual pressure and/or emitting a slight oil can noise with manual pressure, indicating that the vacuum seal has been broken. A concave, domed or flexible depression may also indicate that even if the lid has not been removed from the container, the vacuum seal has been compromised. Once the vacuum seal has been released or compromised, the contents of the container will typically have a more limited shelf life.

When the lid closure is retained by a vacuum seal alone, a common tool for releasing the seal is one that is adapted to pry the edge of the lid away from the container; however, this may cause permanent damage of the lid, such that it may be difficult to reuse the lid closure to provide a subsequent good seal. If the lid closure is also adapted for threaded engagement with the container, conventional procedures for loosening the lid may involve, for example, tapping the jar or bottle on a surface, hitting a corner of the lid with a utensil, or running hot water over the lid closure to expand the lid material away from the containment vessel material. Such procedures may crack the container or introduce water or glass chips into the product, which may be difficult to remove.

In order to assure the quality and shelf life of stored food contents, the vacuum seal must generally be impermeable to fluids and gases. Accordingly, releasing the vacuum seal to open the container may be difficult to accomplish by manual manipulation alone. Many of the food articles stored in vacuum sealed containers, such as condiments and sauces, are stored with screw lids. It can be difficult for people to open and reseal screw lids, especially people who are physically disabled, elderly, suffering from carpal tunnel syndrome, arthritis, tennis elbow, sprains, and/or the like and persons with weakness in their hands or arms.

Accordingly, there is a need to provide a mechanism for easily releasing the vacuum seal of jars, bottles and similar containers which avoids prior difficulties and makes opening and re-establishing a vacuum seal quick, easy and safe.

SUMMARY OF THE INVENTION

In various representative aspects, the present invention provides an apparatus and method for releasing a vacuum seal. Exemplary features are generally disclosed as including methods for puncturing a portion of a lid closure with a penetrator device and optionally sealing the puncture with a laminar valve.

Advantages of the present invention will be set forth in the Detailed Description which follows and may be obvious from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside in the details of construction and operation as more fully hereafter depicted, described and claimed—reference being made to the accompanying drawings forming a part hereof, wherein like numerals refer to like parts throughout. Other elements, operational features, applications and/or advantages may become apparent in light of certain exemplary embodiments recited in the Detailed Description, wherein:

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are generally used for distinguishing between similar elements and not necessarily for describing a sequential or chronological order. Moreover, the terms "front", "back", "top", "bottom", "over", "under", and the like, if any, are generally employed for descriptive purposes and not necessarily for comprehensively describing exclusive relative position or order. Any of the preceding terms so used may be interchanged under appropriate circumstances such that various embodiments of the invention described herein, for example, are capable of operation in orientations and environments other than those explicitly illustrated or otherwise described.

DETAILED DESCRIPTION OF EXEMPLARY EMBODIMENTS

The following descriptions are of exemplary embodiments of the invention and the inventor's conception of the best mode and are not intended to limit the scope, applicability or configuration of the invention in any way. Rather, the following Description is intended to provide convenient illustrations for implementing various embodiments of the invention. As will become apparent, changes may be made in the function and/or arrangement of any of the elements described in the disclosed exemplary embodiments without departing from the spirit and scope of the invention.

Typically, the pressure inside a vacuum sealed food container (e.g., "jar") is much lower than atmospheric pressure. It will be appreciated that as used herein, the term "jar" may be understood to include or alternatively reference a bottle, a lid, a cap or any other containment volume or containment volume closure that may be suitably adapted to provide at least a partial vacuum seal of the internal volume disposed therein.

The lid of a jar typically has a large force pressing the sealing surface to the lip of the jar due to a differential pressure between the external environment and the internal containment volume. This force on the lid translates into friction on the sealing surface. The equation describing this friction force f may be given as:

$$f=\mu F_{normal}$$

where $\mu$ is the coefficient of friction of the lid seal and the lip of the jar, for instance, and $F_{normal}$ is the normal force created by the vacuum pressure on the lid closure.

Figure 1:
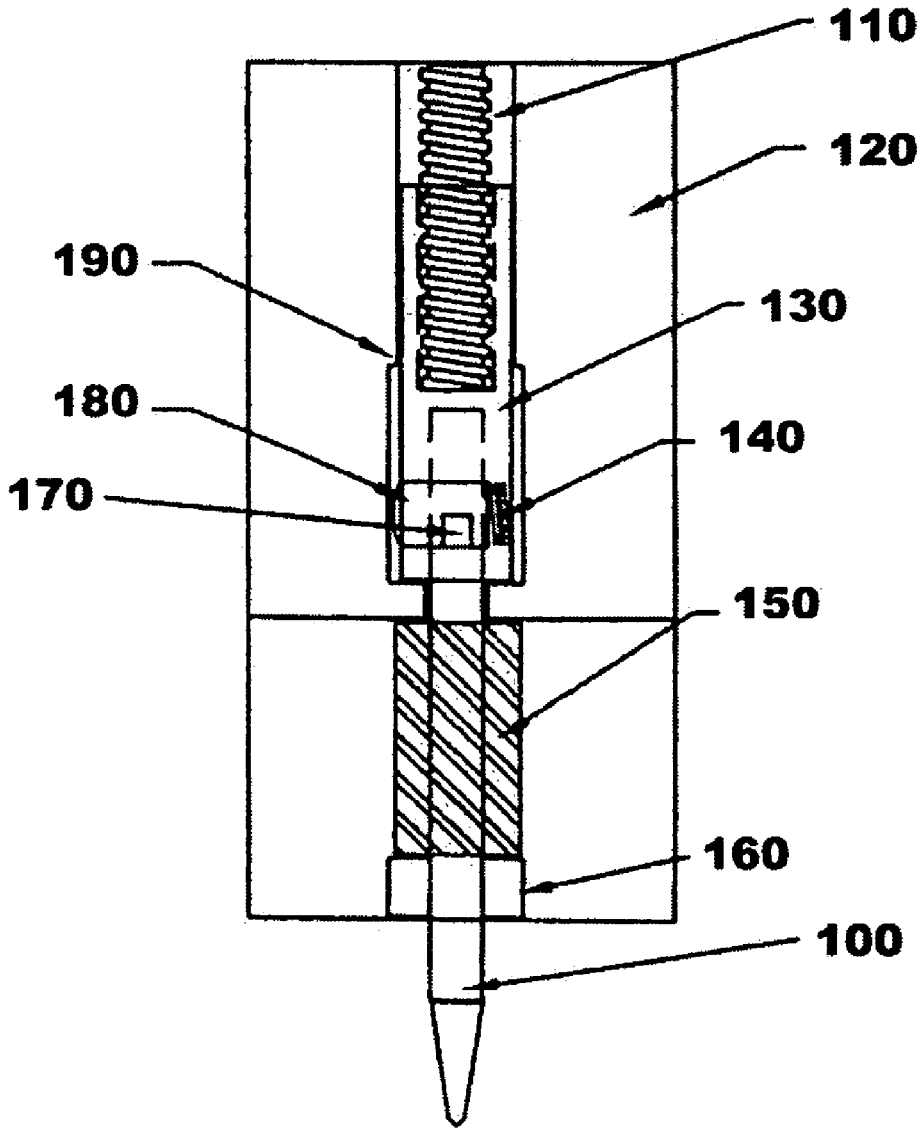
FIG. 1 representatively illustrates a vacuum seal release device in accordance with an exemplary embodiment of the present invention.

As generally depicted for example in FIG. 1, a representative and exemplary embodiment of the present invention provides a vacuum release device that is adapted to penetrate the lid closure of a jar with a small diameter penetrator 100, leaving a small hole. The resulting hole allows the pressure inside the jar to equalize with atmospheric pressure, thereby substantially eliminating the normal force on the jar lid closure, and therefore the associated vacuum-induced friction forces at the sealing surface.

The penetrator 100 point may be placed perpendicular and substantially normal to the top surface of the lid closure. The housing 120 is pressed down (e.g., toward the lid closure), which in turn forces the penetrator 100 and striker 130 up, thus pre-loading the load spring 110. The load spring 110 is compressed by the upward movement of the striker 130. When the trigger pin 180 comes into contact with the trigger block 190, the trigger pin 180 is forced into a set hole in the penetrator 100. The trigger pin 180 has a hole of a larger diameter than the striker 130. The movement of the trigger pin 180 aligns the trigger pin hole and the striker 130. The pre-loaded load spring 110 forces the striker 130 through the trigger pin hole to strike the penetrator 100. This in turn forces the penetrator 100 through the lid closure.

The light return spring 150 forces the penetrator 100 down until the penetrator 100 contacts the penetrator down stop 160. The striker 130 and penetrator 100 are dimensionally configured such that the trigger spring 140 forces the trigger pin 180 to set against the striker set pin 170, which is inside the trigger pin hole. The arrangement of the trigger pin hole and the striker set pin 170 are such that the trigger pin 180 is retained within the penetrator 100. This arrangement provides a 'hair trigger' that may be automatically reset against the trigger block 190 each time the jar lid vacuum release device is used.

Figure 2:
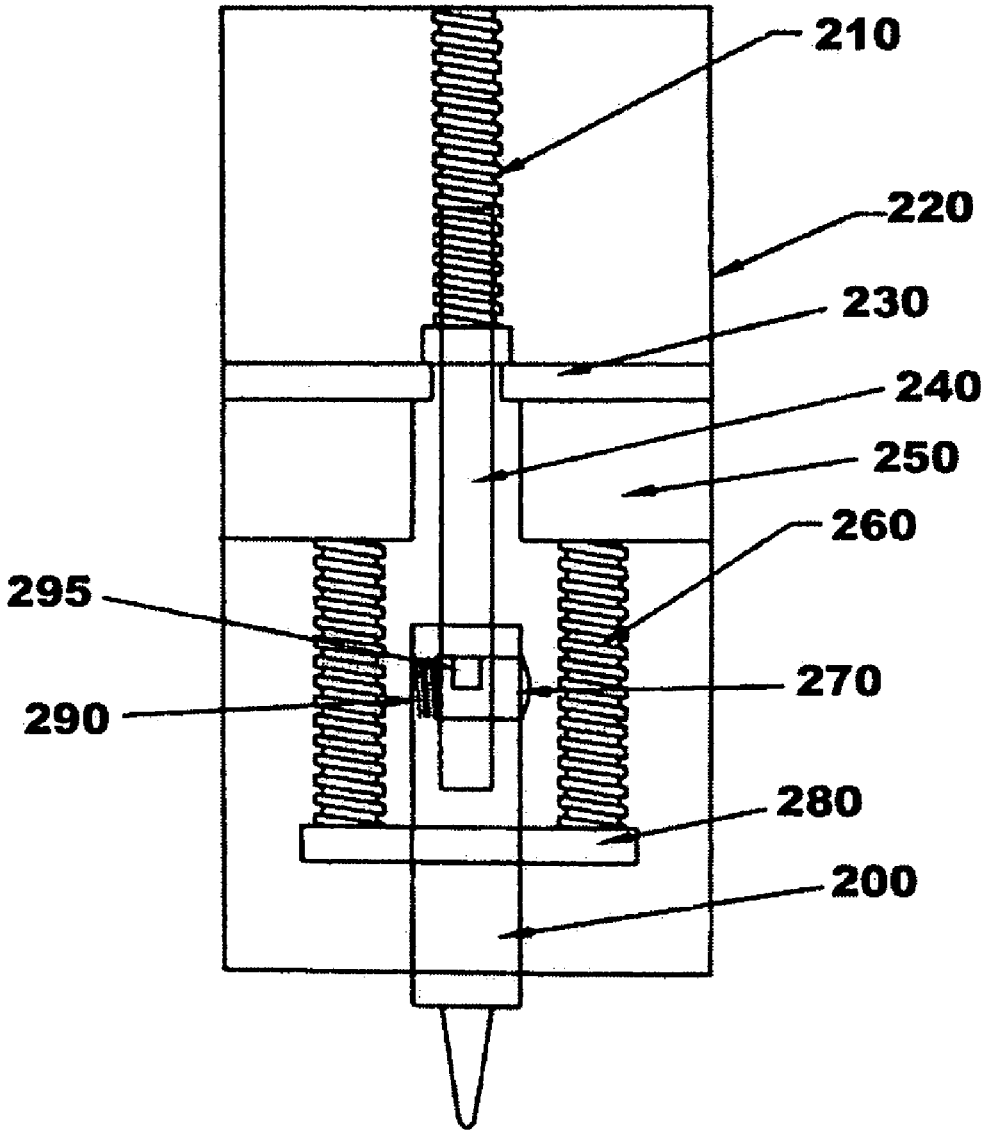
FIG. 2 representatively illustrates a vacuum seal release device in accordance with another exemplary embodiment of the present invention.

In an alternative exemplary embodiment depicted in FIG. 2 for example, the penetrator 200 point may be placed perpendicular and substantially normal to the top surface of the lid closure. The housing 220 is pressed down (e.g., toward the lid closure), which in turn forces the penetrator 200 and striker 240 up, thus pre-loading the load spring 210. The load spring 210 is compressed by the upward movement of the striker 240. When the trigger pin 270 comes into contact with the trigger block 250, the trigger pin 270 is forced into a set hole in the striker 240. The trigger pin 270 generally has a hole of a larger diameter than the striker 240. The movement of the trigger pin 270 aligns the trigger pin hole and the striker 240. The pre-loaded load spring 210 forces the striker 240 against the striker down stop 230 to strike the penetrator 200. This in turn forces the penetrator 200 through the lid closure.

The light return springs 260 force the penetrator 200 down until the penetrator 200 contacts the penetrator down stop 280. The striker 240 and penetrator 200 are dimensionally configured such that the trigger spring 290 forces the trigger pin 270 to set against the striker set pin 295, which is inside the trigger pin hole. The arrangement of the trigger pin hole and the striker set pin 295 are such that the trigger pin 270 is retained within the penetrator 200. This arrangement provides a 'hair trigger' that may be automatically reset against the trigger block 250 each time the lid closure vacuum release device is used.

Figure 3:
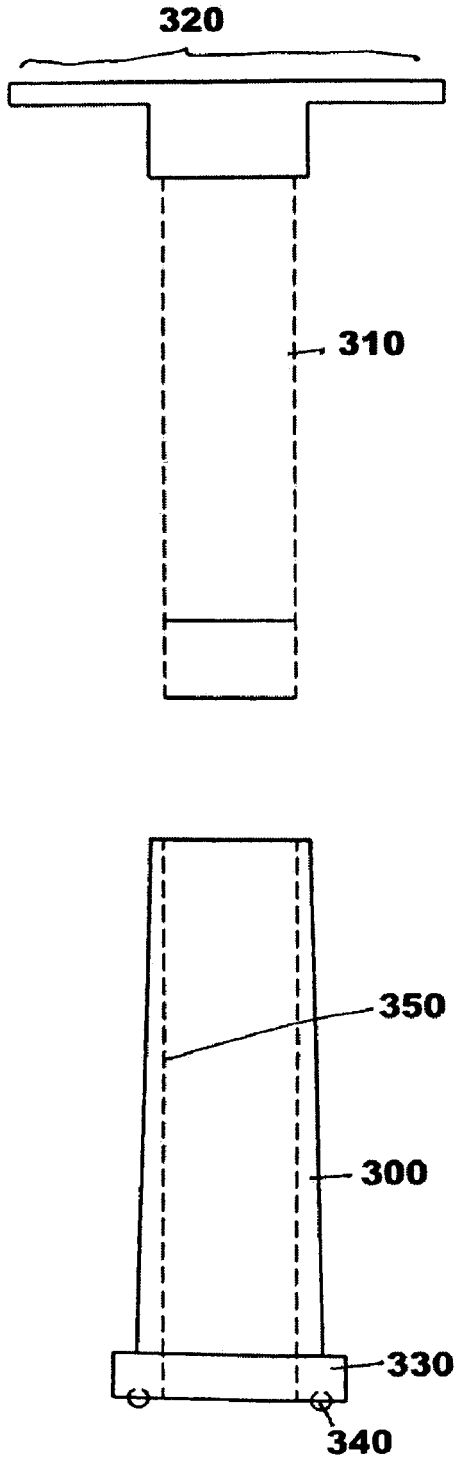
FIG. 3 representatively illustrates a partially exploded view of a vacuum device that may be used in conjunction with various embodiments of the present invention.
Figure 4:
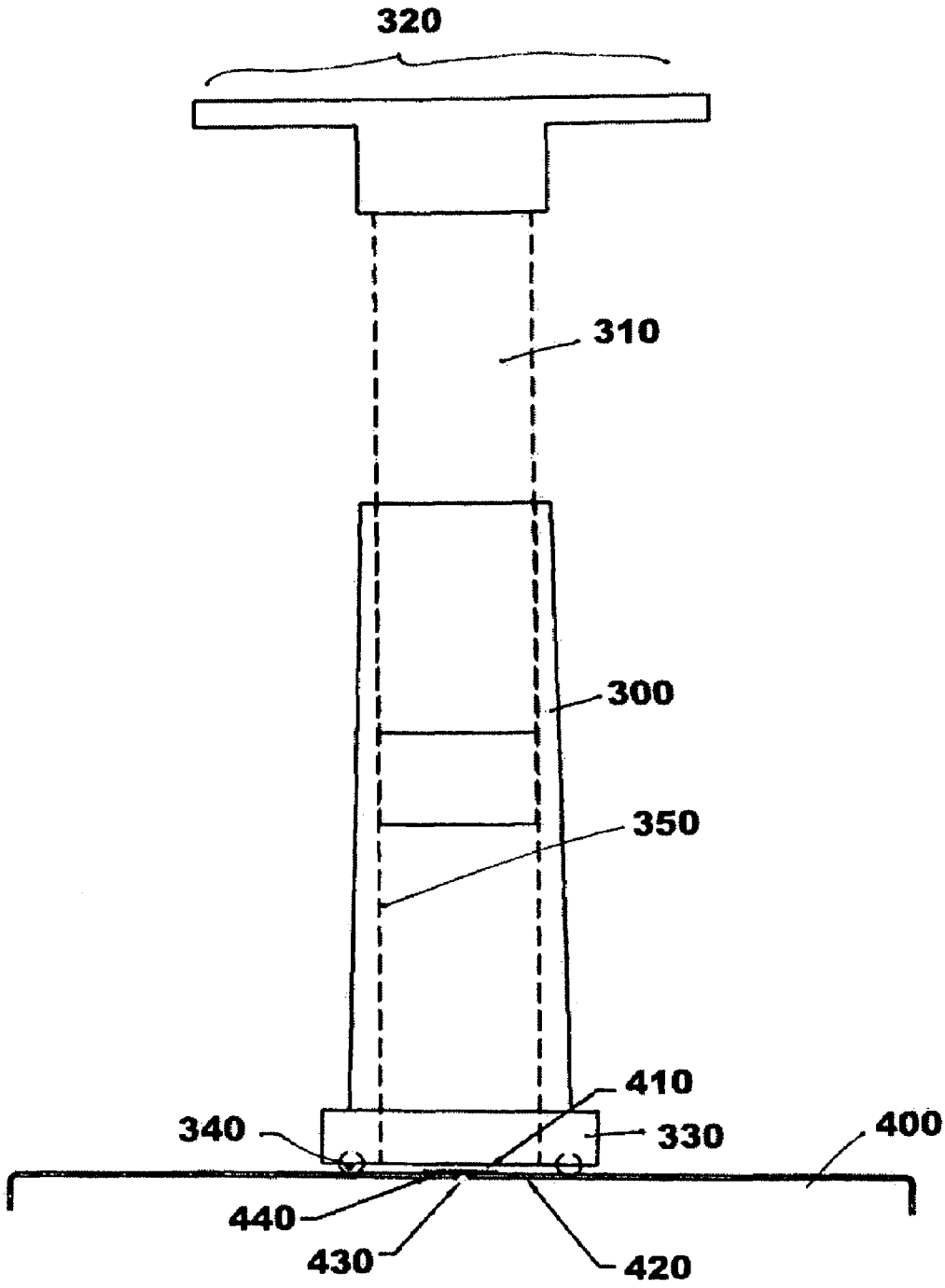
FIG. 4 generally depicts the vacuum device of FIG. 3 in a representative operational configuration and environment.

Once a jar is opened, the food contained therein is exposed to the atmosphere. The jar evacuator representatively illustrated for example in FIGS. 3 and 4, is a hand-held vacuum pump 300, 310 combined with a substantially laminar seal 410 on the surface 420 of lid closure 400 that may be used to reseal the jar.

Without a seal closure 410, the hole 430 may pose a problem with respect to food spoilage. A metalized plastic sheeting with integral PST (pressure sensitive tape) may be provided to re-establish a contiguous sealing lid. Metalized plastic sheeting with integral PST may be provided on a roll or package with easy dispensing, much like conventional cellophane tape. Additionally, metalized plastic sheeting with integral PST is typically FDA approved and may be used to provide a food grade seal for the hole 430.

In general, the hole 430 in the lid closure allows for the use of a vacuum resealing device to be applied. For example, a small hole 430 is placed in the lid 400 of the jar or container to be resealed in a fashion substantially conforming to the method described vide supra. A small, thin laminar valve 410 is generally placed over the hole 430. The valve may have a small amount of PST on one side or corner 440, to attach it to the lid, but typically not directly over the hole 430.

The hand-held vacuum pump 300, 310 is placed over the hole 430 and valve 410 and the pump 300, 310 operated to evacuate the area under the pump 300, 310 and the inside of the containment volume. Lower pump housing collar 330 may be additionally adapted to provide a sealing surface 340 (e.g., gasket, etc.) between the vacuum pump lower housing 300 and the lid 400. As the pump operating handle 320 is moved up with respect to lower pump housing 300, the pumping column 310 is disposed within the interior volume 350 of lower pump housing 300 in a manner that draws a partial vacuum in interior volume 350. Valve 410 lifts up as air is removed from the jar. The differential pressure experienced across the valve 410 forces the valve 410 down on top of the hole 430, thereby providing a vacuum seal in the containment volume.

The hole 430 in the lid 400 and the valve 410 allow for simple release of the vacuum by lifting the valve 410, for example by hand, and re-evacuation by the methods described vide supra.

Laminar valve seal 410 may comprise a small flexible flap of rubber, silicone, or any other type of sealing material, whether now known or otherwise hereafter described in the art, which has suitable flexibility and sealing properties. The valve 410 may have one end coated in PST or other adhesive. Any adhesive material may be used, whether now known or otherwise hereafter described in the art, which has suitable adhesive properties to adhere the laminar valve or seal 410 to the lid surface 420 thereby holding the valve or seal 410 in position. Alternatively, conjunctively or sequentially, laminar valves/re-valves/seals may be used and adapted to comprise a substantially integrated feature of a lid closure designed for engagement with a jar. In such an embodiment, the jar seal may be release and re-sealed prior to subsequent storage.

Figure 5:
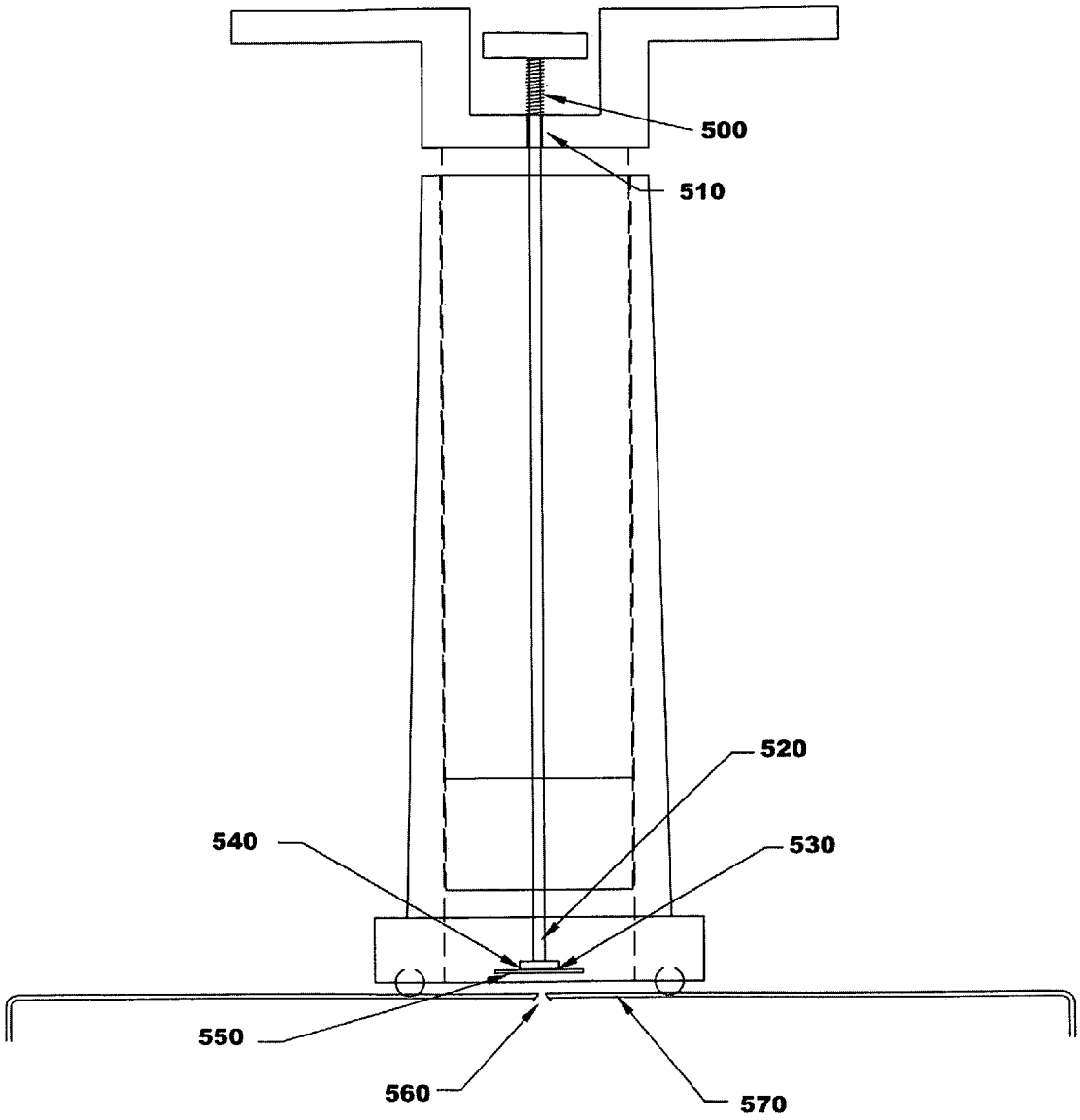
FIG. 5 generally illustrates another vacuum device that may be used in conjunction with various embodiments of the present invention.

FIG. 5 generally depicts an alternative exemplary embodiment in accordance with the present invention that provides the ability to apply an adhesive seal 530 over the puncture hole 560 in the lid 570 of the jar while achieving or otherwise maintaining a vacuum in the jar. Plunger 520 is generally suspended inside the piston/handle assembly of the vacuum pump and is typically displaced with the movement of the piston as the pump is operated. Seal 530 allows substantially linear movement of plunger 520 within the piston while maintaining a vacuum pressure between the vacuum body (e.g., jar lid 570) and the vacuum piston. Spring 500 generally retains plunger 520 in a position such that the distal end of plunger 520 does not typically contact lid surface 570 until the top of plunger 520 is depressed. Alternatively, conjunctively or sequentially, plunger 520 may be suitably adapted to automatically descend and apply seal 530 in correspondence to the vacuum force experienced by plunger 520.

Metalized plastic or other suitable material may be provided to accomplishing sealing of the contents of the vessel from the exterior environment. In a representative application, seal 530 will generally seal hole 560 after a vacuum has been drawn on, for example, a jar. Typically seal 530 will comprise a sealing element and generally not a "valve" element.

To secure seal 530 to plunger 520 prior to deployment, a double-sided tape or pressure sensitive tape material may be employed wherein the side of seal 530 attaching to the bottom of plunger 520 (i.e., the upper side 540) is generally less "sticky" than the side attaching to the top of lid surface 570 (i.e., the lower side 550). Various other means, whether now known or otherwise hereafter described in the art, may be employed for mechanically releasable attachment of seal 530 to plunger 520 wherein said attachment does not substantially impede application of seal 530 to lid surface 570.

In operation, seal 530 may be attached to the bottom surface of plunger 520 within the vacuum tool generally depicted in FIG. 5. The vacuum tool may then be placed over a lid surface generally encompassing the hole 560 in the lid surface 570. The vacuum pump may then be operated to at least partially evacuate air for the vessel (i.e., jar) thereby establishing a pressure differential (e.g., vacuum). While retaining the seal of the vacuum tool to the lid surface 570, plunger 520 may be depressed in order to apply seal 530 over the hole 560 in the vessel's lid 570.

In general, the term "valve" may be understood to reference a configuration whereby at least a portion of the valve may be at least partially displaced for at least one of substantially equilibrating the interior pressure of a containment volume with the exterior pressure, or at least a portion of the valve may be at least partially displaced during the action of establishing a pressure differential between the interior pressure and the exterior pressure of a containment volume. Alternatively, conjunctively or sequentially, the term "seal" may be generally understood to reference a configuration whereby a majority portion of the seal is substantially securely adhered to the surface of a containment lid around or about a vent opening for the purpose of establishing a contiguous seal without necessarily being adapted for partial displacement in accordance with the "valve" embodiment described vide supra.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any device claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

The invention claimed is:

1. A vacuum release device, said device comprising:

a penetrator member disposed within a housing;

said penetrator having a first set position and a strike position;

a striker disposed within said housing;

a load spring, wherein said housing is configured to depress the load spring when force is applied to the housing, and the load spring is suitably adapted to provide, upon expansion of the load spring, an application of force to said striker such that the striker applies force to the penetrator to drive the penetrator from said first set position to said strike position;

a return spring suitably adapted to provide an application of force to said penetrator to reposition the penetrator from said strike position to a second set position; and a trigger mechanism for actuating expansion of said load spring.

2. The vacuum release device of claim 1, wherein said first set position is substantially equivalent to said second set position.

3. The vacuum release device of claim 1, wherein said penetrator further comprises an at least partially tapered point.

4. The vacuum release device of claim 1, wherein said housing is ergonomically adapted for manual human use.

5. The vacuum release device of claim 1, wherein said trigger mechanism further comprises at least one of a ball lock, a button, a sear, a pin, a lever, a hook, a hasp, a clamp and a clasp.

6. The vacuum release device of claim 1, wherein said trigger mechanism further comprises an extensible striker element that may be manually released by the user.

7. The vacuum release device of claim 1, further comprising at least one of a trigger block, a trigger pin, a penetrator set pin, a striker set pin, a trigger spring, a penetrator down stop and a striker down stop.

8. A vacuum release device, said device comprising:

a penetrator member disposed within a housing, wherein said housing is configured to depress a load spring within the housing when force is applied to the housing;

said penetrator having a first set position and a strike position;

said device suitably adapted to provide an application of force to said penetrator to drive the penetrator from said first set position to said strike position in response to expansion of said load spring, said device suitably adapted to provide an application of force to said penetrator to reposition the penetrator from said strike position to a second set position; and a trigger mechanism for actuating expansion of said load spring.

9. The vacuum release device of claim 8, wherein said first set position is substantially equivalent to said second set position.

10. The vacuum release device of claim 8, wherein said penetrator further comprises an at least partially tapered point.

11. The vacuum release device of claim 8, wherein said housing is ergonomically adapted for manual human use.

12. The vacuum release device of claim 8, wherein said trigger mechanism comprises at least one of a ball lock, a button, a sear, a pin, a lever, a hook, a hasp, a clamp and a clasp.

13. The vacuum release device of claim 8, wherein said trigger mechanism comprises an extensible striker element that may be manually released by the user.

14. The vacuum release device of claim 8, further comprising at least one of a trigger block, a trigger pin, a penetrator set pin, a striker, a striker set pin, a trigger spring, a penetrator down stop and a striker down stop.

15. A method for releasing a vacuum, said method comprising the steps of:

providing a penetrator member disposed within a housing;

said penetrator suitably adapted for disposition in a first set position and a strike position;

providing a load spring, wherein said housing is configured to depress said load spring when force is applied to the housing, and said load spring is suitably adapted to provide an application of force to said penetrator to drive the penetrator from said first set position to said strike position in response to expansion of said load spring;

providing a return spring suitably adapted to provide an application of force to said penetrator in order to reposition the penetrator from said strike position to a second set position; and actuating expansion of said load spring to drive said penetrator from said first set position to said strike position.

16. The method for releasing a vacuum of claim 15, wherein said first set position is substantially equivalent to said second set position.

17. The method for releasing a vacuum of claim 15, further comprising the steps of:

providing a containment vessel having a lid closure;

placing said penetrator in the proximity of said lid closure; and actuating expansion of said load spring to drive said penetrator from said first position to said strike position.

18. The method of releasing a vacuum of claim 17, further comprising at least one of the steps of:

driving said penetrator from said first set position to said strike position;

penetrating said lid closure with said penetrator member in said strike position;

repositioning said penetrator member to a set position;

removing said penetrator from proximity with said lid closure;

allowing the pressure inside said containment vessel to equilibrate with external atmospheric pressure; and opening said lid closure.

19. The vacuum release device of claim 7, wherein said trigger pin is configured such that depression of the said load spring causes the trigger pin to approach the trigger block, and upon reaching the trigger block the trigger pin actuates the expansion of the load spring.

* * * * *